US011146870B2

(12) United States Patent
Chopra et al.

(10) Patent No.: US 11,146,870 B2
(45) Date of Patent: Oct. 12, 2021

(54) METHOD AND APPARATUS FOR OUTPUTTING AUDIO DATA IN FLEXIBLE ELECTRONIC DEVICE INCLUDING PLURALITY OF SPEAKERS

(71) Applicant: SAMSUNG ELECTRONICS CO., LTD., Suwon-si (KR)

(72) Inventors: Ashish Chopra, Noida (IN); Kanishk Nagpal, Delhi (IN)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/892,734

(22) Filed: Jun. 4, 2020

(65) Prior Publication Data

US 2020/0389713 A1 Dec. 10, 2020

(30) Foreign Application Priority Data

Jun. 4, 2019 (IN) ..... 201941022216
May 27, 2020 (KR) ..... 10-2020-0063890

(51) Int. Cl.
*H04R 1/02* (2006.01)

(52) U.S. Cl.
CPC ..... *H04R 1/02* (2013.01)

(58) Field of Classification Search
CPC ... H04R 1/02; H04R 1/20; H04R 1/26; H04R 1/32; H04R 1/323; H04R 1/403; G06F 1/1641; G06F 1/1652
See application file for complete search history.

(56) References Cited

U.S. PATENT DOCUMENTS

| | | | | |
|---|---|---|---|---|
| 7,957,550 | B2 | 6/2011 | Jih-Fon et al. | |
| 8,787,016 | B2 | 7/2014 | Rothkopf et al. | |
| 2005/0105748 | A1 | 5/2005 | Bartell | |
| 2011/0216923 | A1 | 9/2011 | Chiang et al. | |
| 2014/0241551 | A1* | 8/2014 | Kim | H04R 3/12 381/306 |
| 2014/0241558 | A1 | 8/2014 | Yliaho et al. | |
| 2017/0052566 | A1 | 2/2017 | Ka et al. | |
| 2017/0269636 | A1* | 9/2017 | Song | G06F 1/1652 |

FOREIGN PATENT DOCUMENTS

KR 10-2016-0029610 A 3/2016

* cited by examiner

*Primary Examiner* — Jason R Kurr
(74) *Attorney, Agent, or Firm* — Sughrue Mion, PLLC

(57) ABSTRACT

A flexible mobile device that appropriately adjusts the arrangement of a plurality of speakers provided in a mobile device based on the type of audio content includes the plurality of speakers; and a processor configured to analyze audio data; determine an angle between bending sides of the flexible electronic device including the plurality of speakers based on a result of analyzing the audio data; adjust the angle between the bending sides of the flexible electronic device to the determined angle; and output the audio data via the plurality of speakers included in the flexible electronic device in a state in which the bending sides of the flexible electronic device are adjusted to the determined angle.

18 Claims, 26 Drawing Sheets

METHOD AND APPARATUS FOR OUTPUTTING AUDIO DATA IN FLEXIBLE ELECTRONIC DEVICE INCLUDING PLURALITY OF SPEAKERS

CROSS-REFERENCE TO RELATED APPLICATION(S)

This application is based on and claims priority under 35 U.S.C. § 119 to Indian Patent Application No. 201941022216, filed on Jun. 4, 2019, in the Indian Patent Office, and Korean Patent Application No. 10-2020-0063890, filed on May 27, 2020, in the Korean Intellectual Property Office, the disclosures of which are incorporated by reference herein in their entireties.

BACKGROUND

1. Field

The disclosure relates to audio signal processing, implementation of an appropriate position of a speaker by a shape change of a flexible electronic device, and more particularly, to a method and apparatus for controlling an operation of a flexible electronic device.

2. Description of Related Art

Although the performance of a speaker has been improved in mobile devices, due to the size limitation of the mobile device itself, there are limits to playing audio content with a sufficiently high performance in mobile devices.

Due to the limitations of speaker performance in mobile devices, in many cases, the loudness of audio content output being produced by loudspeakers is below the desired level and on higher loudness levels the sound quality deteriorates. More importantly, the audio content being played on the loudspeaker might not be apt for the configuration of loudspeaker. For example, when the audio content is stereo content, a mono-loudspeaker might not produce appropriate output—music effects when the audio content is mono content, a dual-loudspeaker may lose the desired loudness.

Thus, there is a need for a method and apparatus for implementing an appropriate loudspeaker configuration in a mobile device according to the nature or type of audio content.

SUMMARY

Provided are a method and an apparatus for appropriately adjusting an arrangement of a plurality of speakers provided in a mobile device according to the type of audio content in a flexible mobile device.

Additional aspects will be set forth in part in the description which follows and, in part, will be apparent from the description, or may be learned by practice of the presented embodiments.

According to an aspect of the disclosure, provided is a method of appropriately adjusting the arrangement of a plurality of speakers provided in a mobile device according to the type of audio content. The method may include analyzing audio data; identifying an angle between bending sides of the flexible electronic device including the plurality of speakers based on the analysis of the audio data; adjusting the angle between the bending sides of the flexible electronic device to the identified angle; and outputting the audio data via the plurality of speakers included in the flexible electronic device in a state in which the bending sides of the flexible electronic device are adjusted to the identified angle.

According to an aspect of the disclosure, a flexible electronic device that appropriately adjusts the arrangement of a plurality of speakers provided in a mobile device according to the type of audio content includes the plurality of speakers; and a processor configured to analyze audio data; identify an angle between bending sides of the flexible electronic device including the plurality of speakers based on a result of analyzing the audio data; adjust the angle between the bending sides of the flexible electronic device to the identified angle; and output the audio data via the plurality of speakers included in the flexible electronic device in a state in which the bending sides of the flexible electronic device are adjusted to the identified angle.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
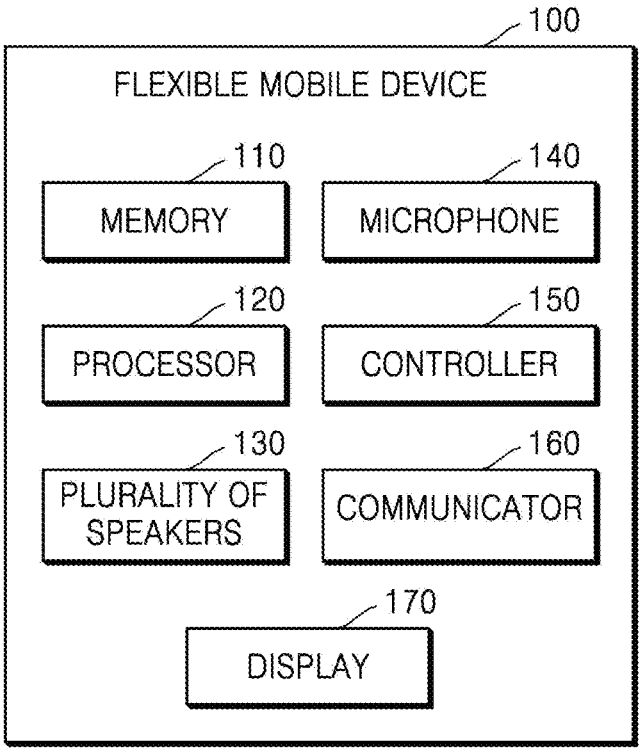
FIG. 1 is a block diagram of a flexible electronic device according to an embodiment.

Terms used herein will be described in brief, and the disclosure will be described in detail.

Although terms used in the disclosure are selected with general terms popularly used at present under the consideration of functions in the disclosure, the terms may vary according to the intention of those of ordinary skill in the art, judicial precedents, or introduction of new technology. In addition, in a specific case, the applicant voluntarily may select terms, and in this case, the meaning of the terms is disclosed in a corresponding description part of the disclosure. Thus, the terms used in the disclosure should be defined not by the simple names of the terms but by the meaning of the terms and the contents throughout the disclosure.

Throughout the entirety of the specification of the disclosure, when it is assumed that a certain part includes a certain component, the term 'including' means that a corresponding component may further include other components unless a specific meaning opposed to the corresponding component is written. The term used in the embodiments such as "unit" or "module" indicates a unit for processing at least one function or operation, and may be implemented in hardware, software, or in a combination of hardware and software.

Throughout the disclosure, the expression "at least one of a, b or c" indicates only a, only b, only c, both a and b, both a and c, both b and c, all of a, b, and c, or variations thereof.

Hereinafter, embodiments of the disclosure will be described in detail with reference to the attached drawings to allow those of ordinary skill in the art to easily carry out the embodiments. However, the disclosure may be implemented in various forms, and are not limited to the embodiments described herein. To clearly describe the disclosure, parts that are not associated with the description have been omitted from the drawings, and throughout the specification, identical reference numerals refer to identical parts.

For ease of understanding in the disclosure, bending and folding may be used in the same or similar meaning.

The functions according to the disclosure may be performed through a processor and memory of a mobile device. The processor may include one processor or a plurality of processors. In this regard, the one processor or the plurality of processors may be a general-purpose processor such as a central processing unit (CPU), an application processor (AP), or a digital signal processor (DSP), a graphic processor such as a GPU or a vision processing unit (VPU), or an artificial intelligence processor such as an NPU. The one processor or the plurality of processors control to process input data according to a predefined operation rule or model stored in the memory. Alternatively, when the one processor or the plurality of processors are the artificial intelligence processors, the artificial intelligence processors may be designed to have a hardware structure specialized for processing a specific artificial intelligence model.

In existing electronic devices, because positions or arrangement of speakers are fixed, the speakers may not be configured flexibly in accordance with audio content. Thus, the speaker configuration on the electronic devices is very difficult to be specialized for the audio content. For example, even when the speaker provided in the electronic device is a stereo speaker, the electronic device is difficult to output appropriate sound when the audio content has mono channel. To the contrary, when the speaker provided in the electronic device is a mono speaker, the mono speaker has limitations of appropriately implementing audio content with stereo channel like movie music or music recorded by the orchestra Even when the electronic device has multiple speakers, because sound output differs according to relative positions of the multiple speakers and audio content, the electronic device is difficult to output dynamic sound appropriate to the audio content.

Further, the stereo speaker configuration suffers from interference of audio signals when the multiple speakers are not appropriately far apart. To the contrary, when the multiple speakers are very far apart then the electronic device may produce sound output inappropriate to certain audio content. Thus, because, for example, rich sound is difficult on speakers of mobile devices having limited output, users use separate external speakers to play audio content stored in mobile devices. For example, rich sound effects like surround sound require multiple speakers which should be configured in a pre-determined arrangement. This surround effect is not possible on mobile electronic devices.

FIG. 1 is a block diagram of a flexible electronic device 100 according to an embodiment.

The flexible electronic device 100 may be, for example, but not limited to a smart social robot, a smart watch, a cellular phone, a smart phone, a Personal Digital Assistant (PDA), a tablet computer, an audio player, a video player, an Internet of Things (IoT) device, a laptop computer, or a palmtop computer. The flexible electronic device 100 may include a memory 110, a processor 120, a plurality of speakers 130, a microphone 140, a communicator 160, and a display 170. According to an embodiment, the flexible electronic device 100 may include a controller 150 used to adjust the angle of the flexible electronic device 100.

The flexible electronic device 100 has at least two sides that might not be located on the same horizontal side due to the bending of the flexible electronic device 100. Throughout the disclosure, bending is used with the same or similar meaning to folding.

The processor 120 is coupled to the memory 110, the controller 150, the plurality of speakers 130, the microphone 140, the communicator 160, and the display 170 to execute instructions stored in the memory 110 and to perform various other processes.

The processor 120 may control the plurality of speakers 130 and the microphone 140. The microphone 140 may be a plurality of microphones respectively provided on a plurality of folding sides. The memory 110 stores instructions to be executed by the processor 120. The memory 110 may include non-volatile storage memory. Examples of the non-volatile storage memory may include magnetic hard discs, optical discs, floppy discs, flash memory, electrically programmable memory (EPROM) or electrically erasable and programmable (EEPROM) memory. The memory 110 may, in an embodiment, be considered a non-transitory storage medium. The term "non-transitory" may indicate that the storage medium is not embodied in a carrier wave or a propagated signal. In an embodiment, the non-transitory storage medium may store data that may, over time, change (e.g., in Random Access Memory (RAM) or cache).

The communicator 160 is configured for communicating internally between internal hardware components and with external devices via one or more networks.

In an embodiment, the flexible electronic device 100 may receive media contents for outputting at at least one of the plurality of speakers 130. The media contents may include a plurality of media channels. The media content may be, for example, audio content or video content including audio, but includes all content including sound. The media content or the audio content may be used in the same sense as audio data throughout the disclosure.

The processor 120 analyzes input audio data.

Figure 2A:
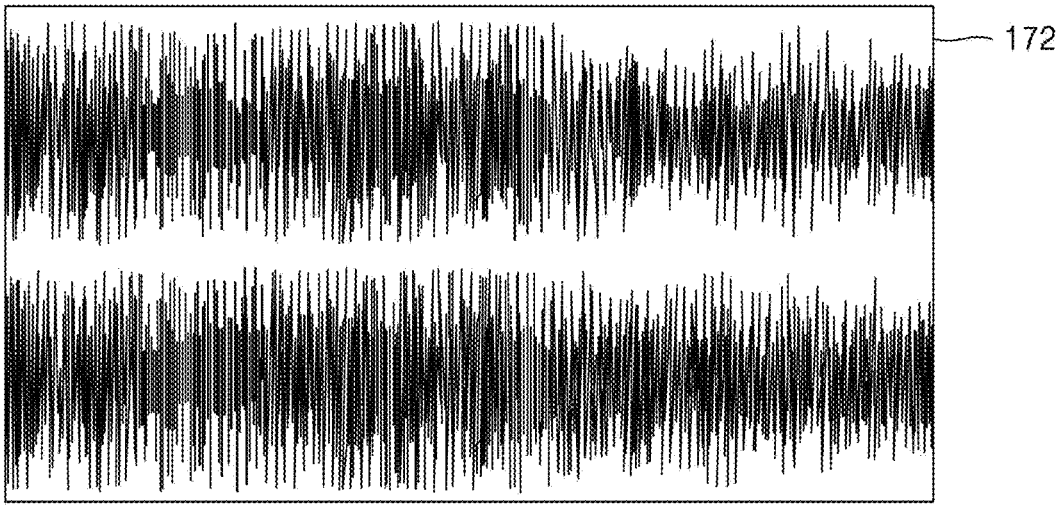
FIG. 2A shows stereo audio data in an audio file.

FIG. 2A shows stereo audio data 172 in an audio file.

Referring to FIG. 2A, when the audio file is a stereo MP3 or a WAV file, the audio file includes two audio channel information. In an embodiment, each of the two-channel information may be left channel information and right channel information.

Figure 2B:
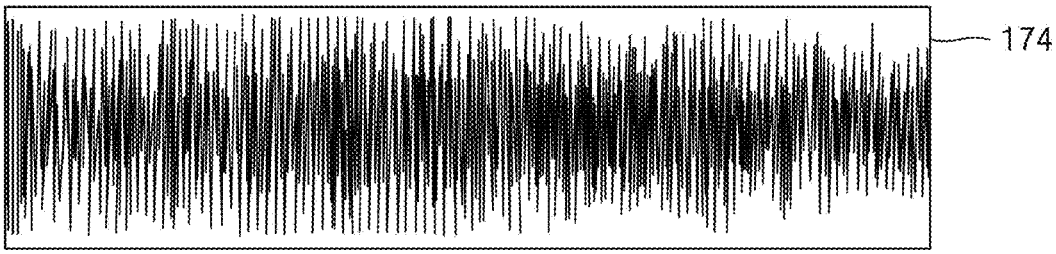
FIG. 2B shows mono audio data in an audio file.

FIG. 2B shows mono audio data 174 in an audio file.

Referring to FIG. 2B, a mono audio file includes only one audio channel information unlike a stereo audio file.

As seen in FIGS. 2A and 2B, the processor 120 may analyze the audio data (the audio file) to identify whether the audio data is audio data including a plurality of channels, and based on the number of channels, identify whether the audio data is the stereo audio data or the mono audio data.

The processor 120 identifies whether the audio file (the audio data) includes a plurality of channels according to an audio file analysis result. When the audio file includes the plurality of channels, because audio is stereo, the processor 120 may set (1) a mono/stereo flag in speaker arrangement data. The processor 120 may change a speaker arrangement or the shape of the flexible electronic device 100 with reference to the speaker arrangement data. The speaker arrangement data may include a field corresponding to a media type according to Table 1 of the disclosure.

In an embodiment, the processor 120 may also plot a three-dimensional (3D) graph based on frequency components of the input audio data. In an embodiment, the processor 120 may control the display 170 to display the plotted 3D graph based on the frequency components of the audio data.

The x axis in the 3D graph indicates a frequency, the y axis indicates a time, and the z axis indicates an amplitude of the audio data. The processor 120 may separate different frequency components in the audio data by performing a frequency Fourier transform on the audio data.

Based on the analysis of the audio data, in particular, by identifying the different frequency components, the processor 120 identifies a plurality of media types included in the audio data and labels the media types. In an embodiment, the plurality of media types may include normal quality mono signal, high quality mono signal, separated bass and speech, and un-separated bass and speech. Also, the plurality of media types may be labeled as a loud mono sound for normal quality mono signal, a 360 degree sound for high quality mono signal, a surround sound for separated bass and speech, and a stereo sound for un-separated bass and speech.

In an embodiment, the processor 120 analyzes the frequency components of the audio data to divide each frequency component or the audio data into various categories such as bass, music effects, speech and clear. Speech is a category that corresponds to a person's speech, not music, and clear means a category without music or speech.

Based on the analysis of the audio data as discussed above, the processor 120 determines a speaker configuration for the plurality of speakers 130. For various speaker configurations, the flexible electronic device 100 may include at least one speaker on each bending side. However, when there three or more bending sides, at least one speaker—a total of three speakers may be configured on each side, but is not necessarily limited thereto. That is, when there are three or more bending sides, the flexible electronic device 100 may include speakers only on the two left and right sides.

When the bending of the flexible electronic device 100 is not a configuration in which at least two sides are completely folded, and instead a plate of a flexible electronic device is continuously bended, the flexible electronic device may include a plurality of speakers along the sides at appropriate intervals.

The speaker configuration may include information about the use of the speaker of the flexible electronic device 100.

According to an embodiment, it is assumed that two sides forming a 0 degree angle completely overlap in the flexible electronic device 100 according to one bending (folding) such that the two sides are completely foldable. Each of a first side that is one folding side and a second side that is another side may be bended from 0 degree to 180 degrees. In addition, a first speaker that is at least one speaker on the first side and a second speaker that is at least one speaker on the second side are provided.

The processor 120 identifies an angle to be formed between the first side and the second side according to the analysis of the audio data.

The flexible electronic device 100 may be bended automatically, rather than bended manually by a person, along a plurality of bending lines (folding lines).

In an embodiment, a user generates an audio data play event to listen to the audio data. The audio data play event may be triggered by, for example, a play touch button push to play specific music. It is assumed that, as a result of analyzing the audio data, 60 degrees is identified as the most optimal angle for reproducing the audio data as an angle between the first and second sides. The processor 120 performs automatic bending such that the angle between the first and second sides is 60 degrees based on the identified angle of 60 degrees. In this regard, the processor 120 drives a bending motor belonging to the controller 150 to perform a bending operation to adjust the angle between the first and second sides of the flexible electronic device 100 to be 60 degrees. The controller 150 for bending may use the bending motor for bending, or may adjust the angle between the first and second sides of the flexible electronic device 100 using a magnetic material or a piezoelectric element.

In an embodiment, when there is no automatic device for bending in the flexible electronic device 100, the processor 120 of the flexible electronic device 100 may recommend the physical bending shape of the flexible electronic device 100 to the user based on the identified angle and the speaker configuration. The processor 120 identifies a shape to be formed by bending the flexible electronic device 100 based on the audio data analysis result and a speaker arrangement provided in the flexible electronic device 100.

In an embodiment, the processor 120 may output the identified angle according to the audio data analysis result through the flexible electronic device 100. For example, as a result of analyzing the audio data, when the angle between the first and second sides is identified to be 60 degrees as the most optimal angle for playing the audio data, the flexible electronic device 100 may output the identified angle through the display 170 or corresponding audio. In an embodiment, the flexible electronic device 100 may display the shape itself to be bended and formed according to the identified angle on the display 170 as an image.

In an embodiment, the identified angle may be displayed on the display 170, and when the user manually adjusts the first and second sides, the adjusted angle may be displayed on the display 170 in real time. That is, the flexible electronic device 100 may display the angle that changes when the first and second sides are bended on the display 170 in real time. Alternatively, a degree of reaching the identified angle from the currently formed angle 0% may be sequentially expressed as % by setting the reaching of the identified angle to 100%. Conversely, the flexible electronic device 100 displays a % value change in real time when the first and second sides are bended by setting the current angle between the two sides to 100% and the identified angle to 0%, such that the angle formed by the first and second sides may easily reach the identified angle when the user manually adjusts the first and second sides of the flexible electronic device 100.

Alternatively, the flexible electronic device 100 may display the identified angle as a target angle on the display 170 and compare and display the angle currently formed by the first and second sides in real time.

In addition, the flexible electronic device 100 may notify the user when the angle formed by the first and second sides reaches the identified angle. The notification may be made by displaying on the angle formed by the first and second sides on the display 170, generating a sound alarm, or through a vibration output.

Figure 3:
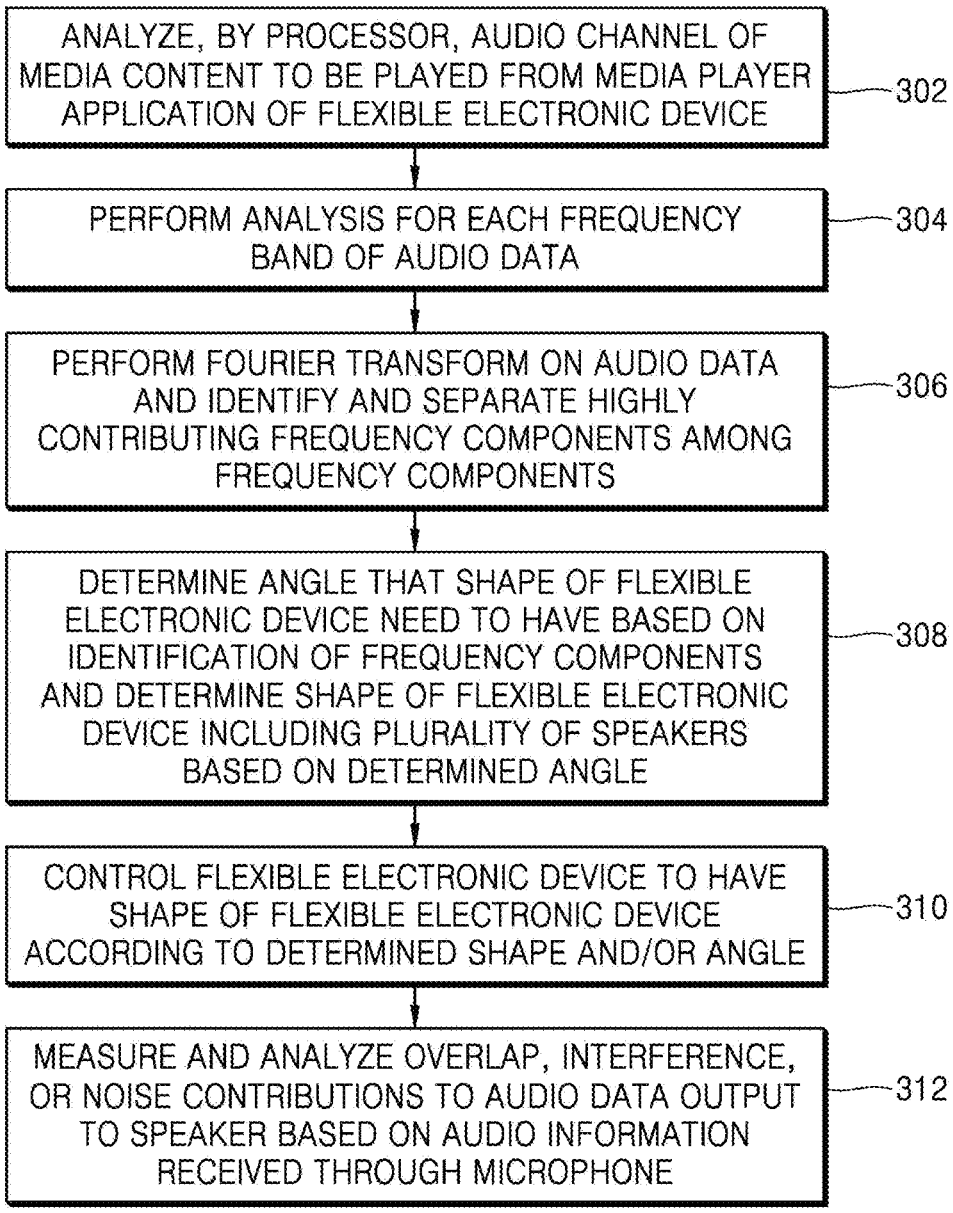
FIG. 3 is a flowchart of a method of controlling operations related to sound output according to an embodiment.

FIG. 3 is a flowchart of a method of controlling operations related to sound output according to an embodiment.

In operation 302, the processor 120 analyzes an audio channel of media content (audio data) to be played from a media player application of the flexible electronic device 100.

In operation 304, the processor 120 performs analysis for each frequency band of the audio data. Frequency components of the audio data are divided into various categories such as bass, music effects, speech and clear.

In operation 306, the processor 120 performs a Fourier transform on the audio data and identifies and separates highly contributing frequency components among the frequency components.

In operation 308, the processor 120 identifies an angle that the shape of the flexible electronic device 100 need to have based on the identification of the frequency components and identifies or determines the shape of the flexible electronic device 120 including the plurality of speakers 130 based on the identified angle.

In operation 310, the processor 120 controls the flexible electronic device 100 to have the shape of the flexible electronic device 100 according to the identified shape and/or angle. In an embodiment, the processor 120 guides the user for the shape such that the shape of the flexible electronic device 100 is identified according to the identified angle. The processor 120 may generate an alarm or vibration output as means for notifying whether the flexible electronic device 100 is close to the identified shape when the user changes the shape of the flexible electronic device 100 according to the guided shape or display, on the display 170, a numerical value indicating whether the flexible electronic device 100 is close to the identified shape when the user changes the shape of the flexible electronic device 100 according to the guided shape.

In operation 312, the flexible electronic device 100 measures and analyzes overlap, interference, or noise contributions to audio data output via a speaker based on audio information received through the microphone 140. The processor 120 may re-analyze the audio data by analyzing the degree of overlap, interference, or noise of the audio currently output through the audio information received through the microphone 140, and may reconfigure the shape based on the re-analysis of the audio information by the flexible electronic device 100. That is, the processor 120 may identify again an angle that needs to be formed by the sides of the flexible electronic device 100. When the angle that needs to be formed by the sides of the flexible electronic device 100 is identified again based on the audio information received through the microphone 140, the processor 120 may reconfigure the flexible electronic device 100 in the shape that needs to be identified by the sides of the flexible electronic device 100 through the controller 150.

Figure 4:
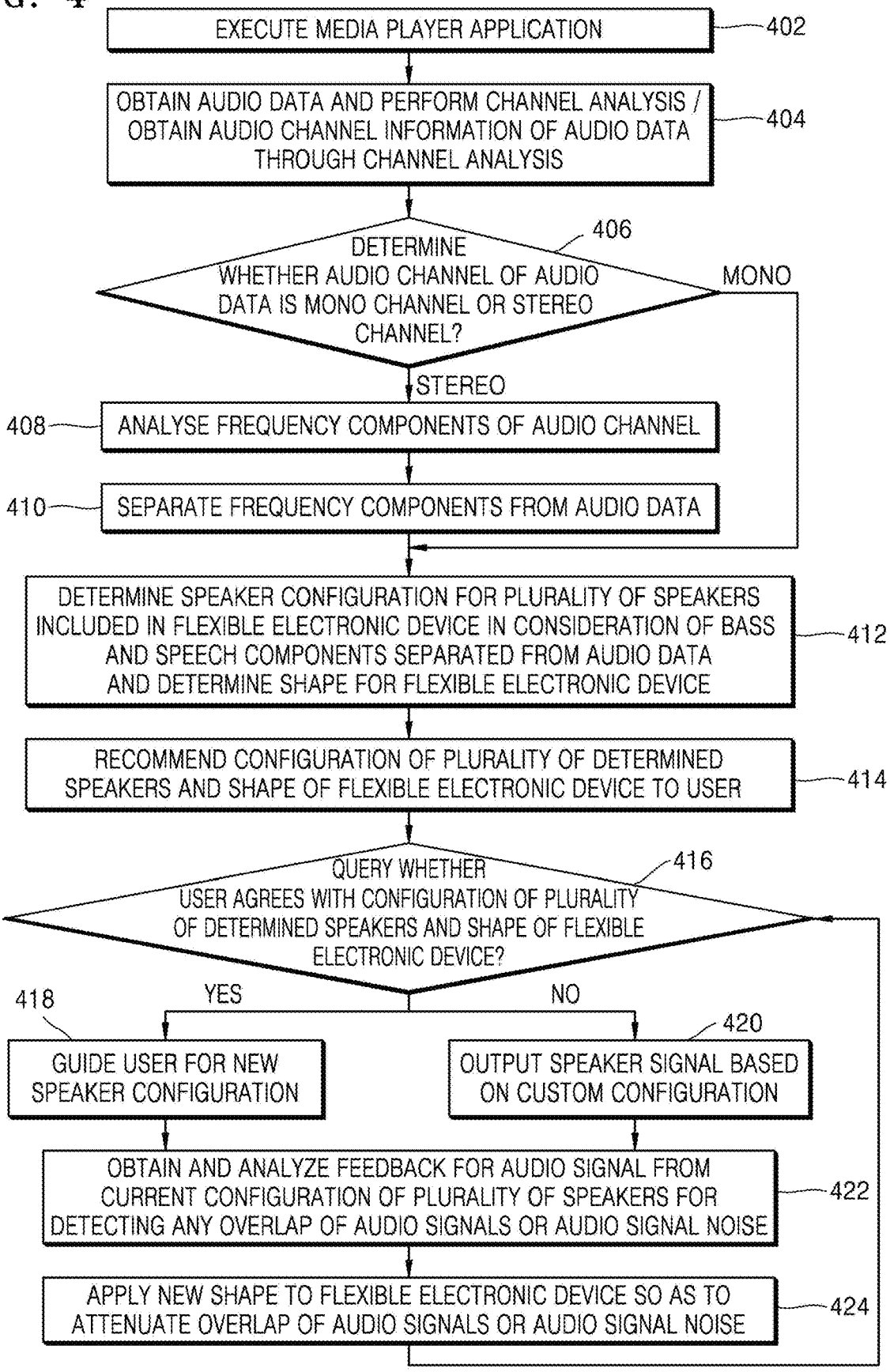
FIG. 4 is a flowchart of a method of controlling operation of the flexible electronic device according to an embodiment.

FIG. 4 is a flowchart of a method of controlling operation of the flexible electronic device 100 according to an embodiment.

In operation 402, a media player application available in the flexible electronic device 100 is executed, and media content (audio content) is ready to be played.

In operation 404, the processor 120 obtains the audio data and performs a channel analysis of the audio data. The processor 120 obtains audio channel information of the audio data through the channel analysis.

In operation 406, the flexible electronic device 100 identifies or determines whether the audio channel of the audio data is a mono channel or a stereo channel. When the audio channel of the audio data is the mono channel then the flowchart proceeds to operation 412. When the audio channel of the audio data is the stereo channel, then the flowchart proceeds to operation 408.

In operation 408, the processor 120 analyses frequency components of the audio channel. In operation 410, the processor 120 separates the frequency components from the audio data. In an embodiment, the processor 120 separates the bass and speech components from the audio data.

In operation 412, the processor 120 identifies a speaker configuration for a plurality of speakers included in the flexible electronic device 100 in consideration of the bass and speech components separated from the audio data. The processor 120 identifies a shape for the flexible electronic device 100 based on the identified speaker configuration.

In operation 414, the flexible electronic device 100 recommends the identified configuration of the plurality of speakers and the shape of the flexible electronic device 100 to the user. The flexible electronic device 100 may show the shape of the flexible electronic device 100 to the user through the display 170. In addition, the flexible electronic device 100 may display an angle of a bending side of the flexible electronic device 100 in a numerical value.

In operation 416, the flexible electronic device 100 queries whether the user agrees with the identified configuration of the plurality of speakers and the shape of the flexible electronic device 100. When the user is satisfied, then the flowchart proceeds to operation 418 and when the user is not satisfied, then the flowchart proceeds to 420.

In operation 418, the flexible electronic device 100 guides the user for a new speaker configuration. In operation 420, the flexible electronic device 100 outputs a speaker signal based on a custom configuration.

In operation 422, the flexible electronic device 100 obtains and analyzes the audio signal from the current configuration of the plurality of speakers 130 as a feedback for detecting any overlap of audio signals or audio signal noise. Obtaining of the audio signal as a feedback may be performed through the microphone 140 corresponding to each of the plurality of speakers 130. That is, according to an embodiment, the flexible electronic device 100 may include the microphones 140 corresponding to the number of the plurality of speakers 130.

In operation 424, when the interference, overlap, or noise of the audio signal is found according to the analysis result, the processor 120 may apply a new shape to the flexible electronic device 100 so as to attenuate the overlap of audio signals or the audio signal noise. In an embodiment, when many overlaps of audio signals occur, the processor 120 may adjust the bending angle to minimize the overlap between an audio signal output from a speaker on the left side and an audio signal output from a speaker on the right side. Here, adjusting the bending angle may mean that an angle between two bending sides is small and that the flexible electronic device 100 is almost folding. In other words, the sides of the flexible electronic device 100 may be folded such that the angle between the two sides formed by the flexible electronic device 100 is within 20 degrees.

In an embodiment, when the angle between the two sides of the flexible electronic device 100 reaches almost 0 degree, an overlap or interference between audio signals rarely occurs.

Figure 5:
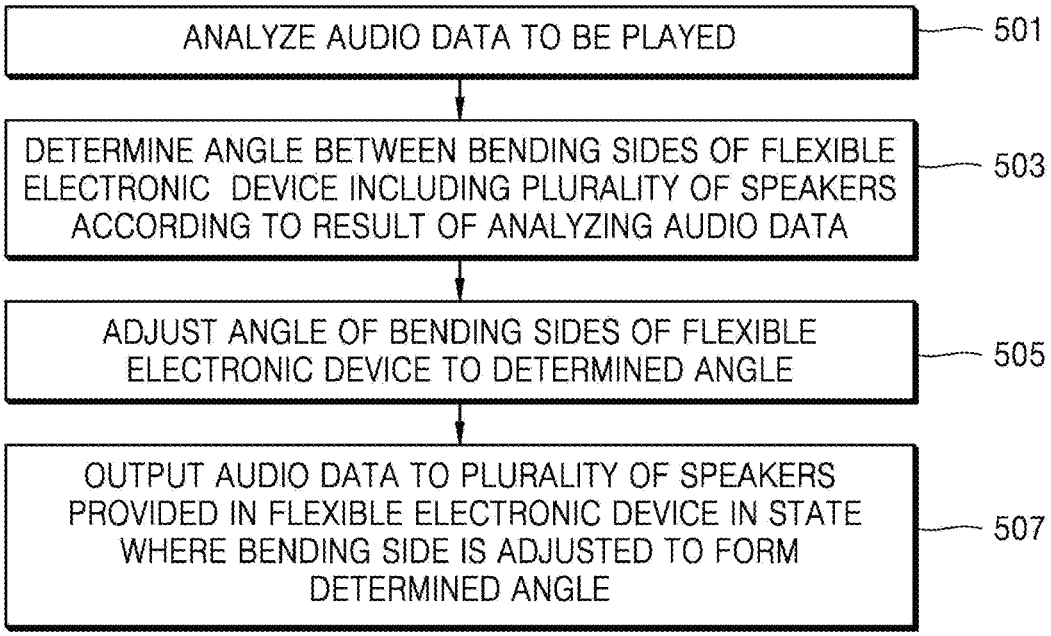
FIG. 5 is a flowchart illustrating an audio output method performed by a flexible electronic device including a plurality of speakers according to an embodiment.

FIG. 5 is a flowchart illustrating an audio output method performed by a flexible electronic device including a plurality of speakers according to an embodiment.

In an embodiment, the flexible electronic device 100 has at least two bending sides each including at least one speaker.

In operation 501, the processor 120 analyzes audio data to be played by a user. In an embodiment, the user generates an event (for example, a music play button push or a video play start command input) that outputs audio data from the flexible electronic device 100 through a media play application.

In an embodiment, the processor 120 identifies whether the audio data is mono channel audio data or stereo channel audio data through an audio data analysis.

In an embodiment, the processor 120 analyzes the frequency components of the audio data during the audio data analysis to identify a degree of the contribution of a plurality of frequency bands. In an embodiment, the plurality of frequency bands may include at least two of a bass band, a music effect band, a speech band, and a clear band. The processor 120 identifies a type of the audio data according to the degree of the contribution of the plurality of frequency bands. In the disclosure, the term 'type of the audio data' may be used interchangeably with the term 'media type'.

In operation 503, the processor 120 identifies or determines an angle between bending sides of the flexible electronic device 100 including a plurality of speakers according to the analysis result of the audio data.

In an embodiment, the processor 120 may identify a bending angle formed between the sides of the flexible electronic device 100 according to the degree of the contribution of the plurality of frequency bands. In an embodiment, when the audio data is identified to be the stereo channel audio data, the processor 120 may identify an angle between the left side and the right side among the bending sides of the flexible electronic device 100 to between 50 degrees and 180 degrees and 60 degrees.

In operation 505, the processor 120 adjusts the angle of the bending sides of the flexible electronic device 100 to the identified angle.

The bending of the flexible electronic device is that at least two sides included in the flexible electronic device are folded or at least one side of a flexible electronic device is curved. When the bending sides of the flexible electronic device 100 forms the identified angle, a related notification may be provided to the user.

The operation of adjusting the angle of the bending sides of the flexible electronic device 100 to the identified angle may include providing an image forming the identified angle between the bending sides of the flexible electronic device 100 through the display of the flexible electronic device 100.

In operation 507, the processor 120 outputs the audio data via the plurality of speakers provided in the flexible electronic device 100 in a state where the bending side is adjusted to form the identified angle.

When an audio output according to the audio data ends or audio according to second audio data different from the audio data needs to be output during the audio output, an event in which the audio data changes to the second audio data is a triggering event. The processor 120 may re-adjust the angle between the bending sides of the flexible electronic device 100 to fit the second audio data based on the triggering event and automatically bend the sides of the flexible electronic device 100 to the re-adjusted angle.

Figure 6:
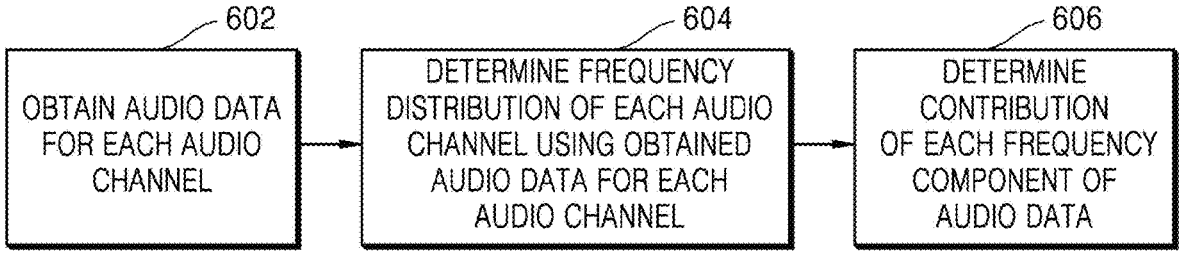
FIG. 6 illustrates identifying the relative contribution of frequency components of audio data according to an embodiment.

FIG. 6 illustrates identifying the relative contribution of frequency components of audio data according to an embodiment.

Referring to FIG. 6, the processor 120 obtains the audio data for each audio channel in operation 602.

Next, in operation 604, the processor 120 identifies or determines the frequency distribution of each audio channel using the obtained audio data for each audio channel.

In operation 606, the processor 120 identifies or determines a degree of the contribution for each frequency component of the audio data.

When the degree of the contribution for each frequency component of the audio data is identified, the processor 120 may identify how the shape of the flexible electronic device 100 is configured so as to output the audio data as the optimal sound.

Figure 7A:
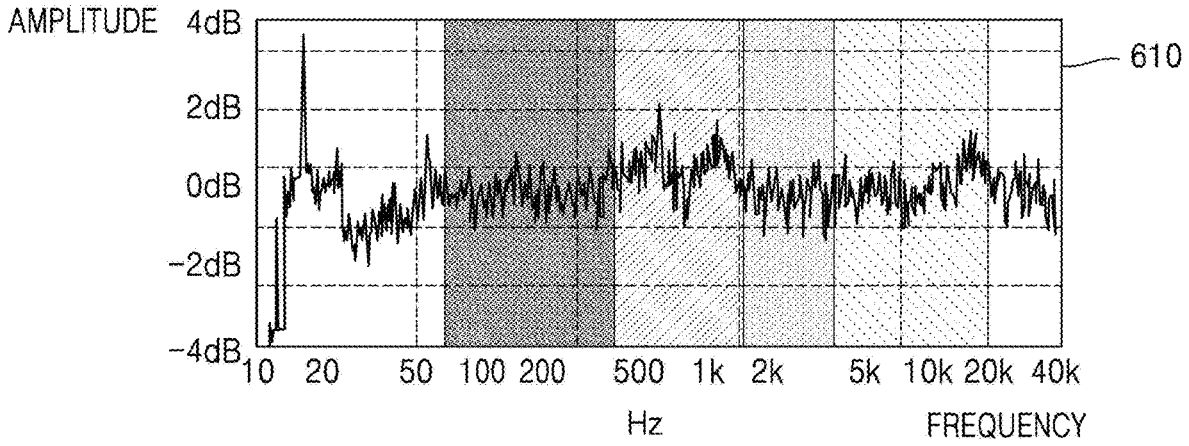
FIG. 7A is a graph showing the frequency distribution of audio data according to an embodiment.

FIG. 7A is a graph 610 showing the frequency distribution of audio data according to an embodiment.

Referring to FIG. 7A, the x axis indicates a frequency band and y axis indicates a sound amplitude (dB). As seen in FIG. 7A, a low frequency band ranging from 60 Hz to 500 Hz is classified as bass, a frequency band ranging from 500 Hz to 2 kHz is classified as music effects, a frequency band ranging from 2 kHz to 4 kHz is classified as speech and a frequency band ranging from 4 kHz to 20 kHz is classified as clear. Based on the frequency distribution, the overall contribution of the individual frequency band components from the audio data for each audio channel is identified.

Figure 7B:
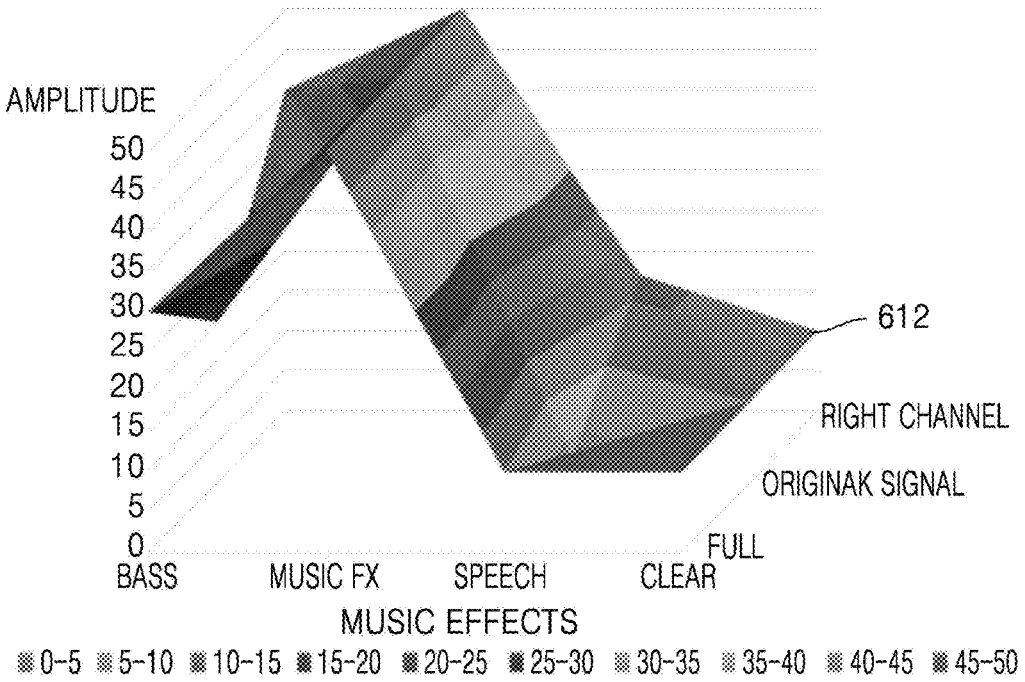
FIG. 7B is a three-dimensional (3D) graph illustrating a frequency band distribution in two-channel audio data according to an embodiment.

FIG. 7B is a 3D graph 612 illustrating a frequency band distribution in two-channel audio data according to an embodiment.

Here, that the audio data has two-channels means that the audio data is stereo audio.

The 3D graph in FIG. 7B shows a 3D spectrogram of audio signal (frequency components) with respect to amplitude. According to the 3D graph of FIG. 7B, the largest amplitude part is music effects (MUSIC FX), and thus the audio data may be a music file.

Figure 7C:
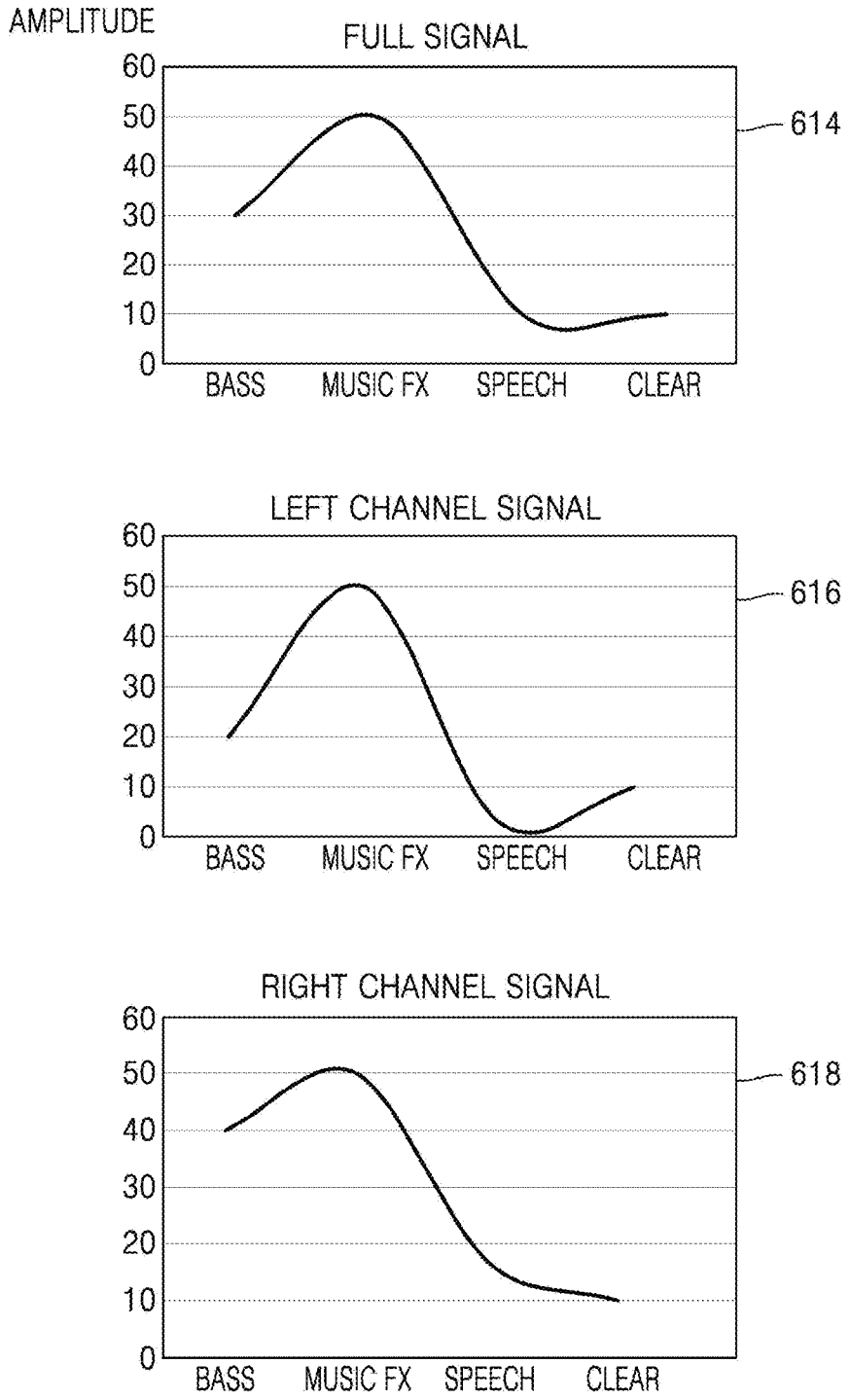
FIG. 7C is a graph showing a frequency band distribution for each channel in two-channel audio data according to an embodiment.

FIG. 7C is a graph showing a frequency band distribution for each channel in two-channel audio data according to an embodiment.

FIG. 7C shows the 3D graph of FIG. 7B that is two-dimensionally separated for each channel.

In FIG. 7C, graph 614 shows the frequency distribution of the entire audio signal. Because the entire audio data is divided into two channels, the audio data may be divided into the frequency distribution of a left channel audio signal in graph 616 of FIG. 7C and the frequency distribution of a right channel audio signal in graph 618 of FIG. 7C.

In the audio signal frequency distribution for the audio data in FIG. 7C, it may be seen that the audio data is a music file with the most prominent music effects. However, it may be seen that the clear part of the left channel audio signal has a larger amplitude than the right channel audio signal. Meanwhile, it may be seen that the amplitude of a bass signal of the right channel audio signal is greater than the amplitude of a bass signal of the left channel audio signal.

In an embodiment, a Fourier transform is used to separate different frequency components in the audio data. In particular, the frequency Fourier transform separates various frequency components when the contribution of a specific frequency band is large. Here, the large contribution of the specific frequency band in the audio data means that the frequency band makes the greatest contribution to identifying the characteristics of the audio data—whether it is speech, bass, or music effects.

Table 1 shows a speaker configuration and a shape of the flexible electronic device 100 identified according to a media type according to an embodiment.

Figure 10:
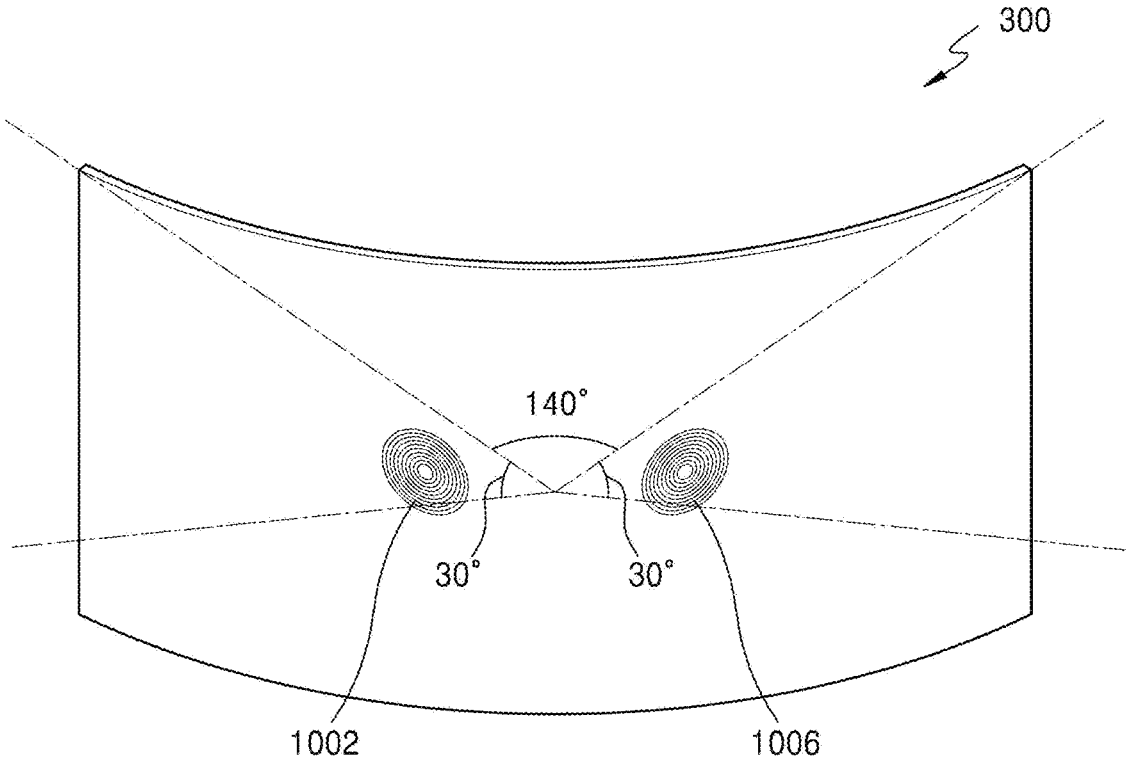
FIG. 10 is a schematic diagram of a flexible electronic device according to an embodiment.

For ease of understanding, the flexible electronic device 100 according to Table 1 may have two bending lines, three bending sides, and three speakers as shown in FIG. 10, or a center side 840 and a central speaker 804 may be omitted in the flexible electronic device 100 of FIG. 10.

without bending. When the media type is a 360 degree sound output, the flexible electronic device 100 outputs sound in a 0 degree bending state. In this regard, the 0 degree bending state means a state in which two bending sides are folded completely.

When the channel type of the audio data is the stereo channel audio, the left and right channel contents output to the left and right speakers are different. In this regard, when the media type is a surround output, the bending angle of flexible electronic device 100 is appropriately 60 degrees. When the media type is a stereo sound output, the bending angle of flexible electronic device 100 is appropriately 60 to 180 degrees.

In Table 1, the media type may be identified as any one or more of bass, music effects, speech, and clear according to frequency analysis and frequency contribution analysis.

Figure 8A:
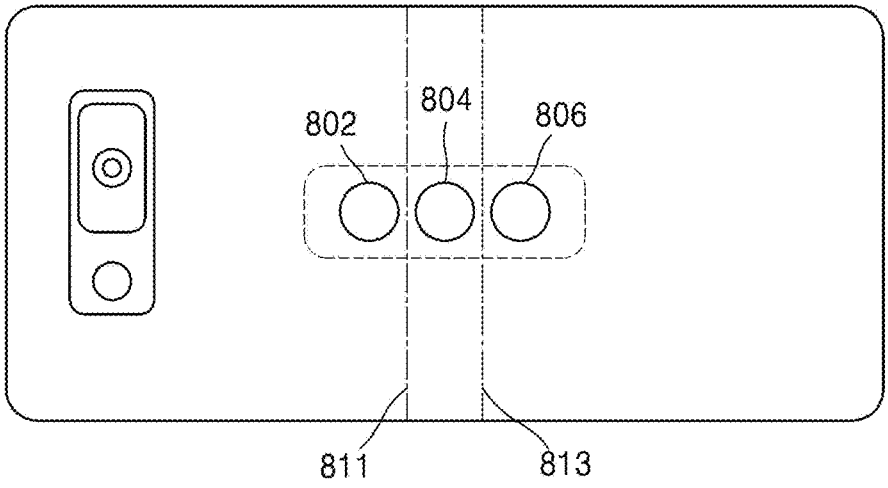
FIG. 8A is a schematic diagram of a flexible electronic device according to an embodiment.

FIG. 8A is a schematic diagram of the flexible electronic device 100 according to an embodiment.

In an embodiment, the flexible electronic device 100 includes three speakers. The three speakers include a left speaker 802, a central speaker 804, and a right speaker 806.

Then, in the flexible electronic device 100, a left bending line 811 that is a folding line between the left speaker 802 and the central speaker 804 is formed, and a right bending line 813 that is a folding line between the central speaker 804 and the right speaker 806 speaker is formed.

As explained in Table 1 above, when the media type is the loud mono speaker output, all the three speakers are used equally to output loud and clear sound without folding of the flexible electronic device 100. Alternatively, the flexible electronic device 100 may use only the central speaker 804 through mode switching—a central speaker use only mode—for reduction of power or when the central speaker 804 has a sufficiently large output or does not need to produce loud sound.

TABLE 1

| Channel type of audio data | Left and Right Channel content | Speaker Configuration | Media Type | Shape of electronic device |
|---|---|---|---|---|
| Mono Channel Audio | Left and Right Channel content is same | All loudspeakers are used Or only central speaker is used | Loud Mono-Speaker output | No bending (bending of 180 degrees as default configuration) |
| | | | 360 Degree Sound Output | bending of 0 degree |
| Stereo Channel Audio | Left and Right content is different | All loudspeakers are used | Surround Sound Output | bending of 60 degrees |
| | | | Stereo Sound Output | Bending among 60 degrees to 180 degrees |

As seen in Table 1, the channel type of the audio data may be classified as the mono channel audio and the stereo channel audio. When the channel type of the audio data is the mono channel audio, the left and right channel contents are same and the same content is output. When the channel type of the audio data is the mono channel audio, and when the flexible electronic device 100 has two bending lines, three bending sides, and three speakers as shown in FIG. 10, for power reduction or when the central speaker output is sufficient, only the central speaker may output.

Figure 8B:
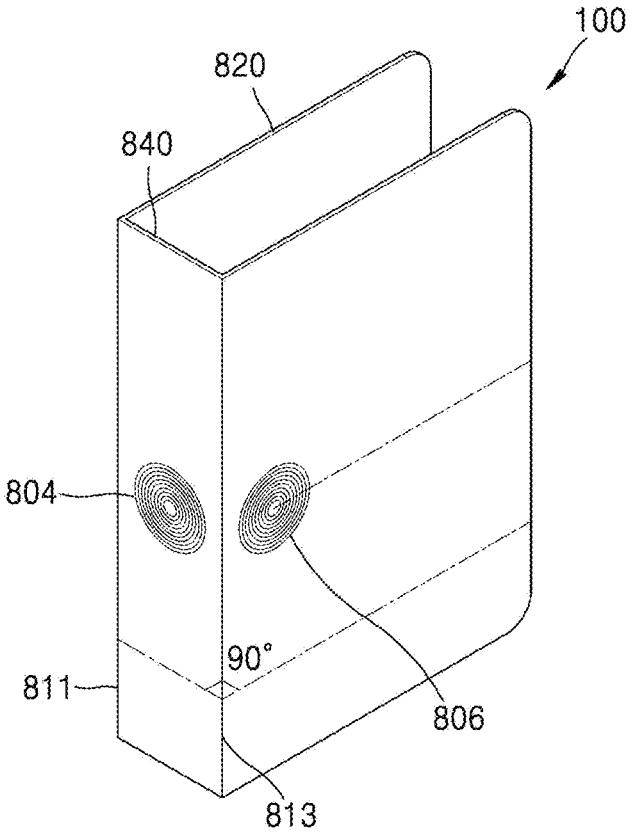
FIG. 8B is a schematic diagram of a flexible electronic device according to an embodiment.

When the media type is identified as a loud-mono speaker output in the mono channel audio then the flexible electronic device 100 outputs speakers in a default configuration FIG. 8B is a schematic diagram of the flexible electronic device 100 according to an embodiment.

In FIG. 8B, sides folded with respect to a left bending line 811 are a left side 820 and a center side 840. Similarly, sides folded with respect to a right bending line 813 are the center side 840 and a right side 860. Similarly in FIG. 8A, the left side 820, the center side 840, and the right side 860 respectively include the at least one speaker among the left speaker 802, the central speaker 804, and the right speaker 806.

In an embodiment, FIG. 8B shows the shape of the flexible electronic device 100 when the media type is identified to require a 360 degree sound output. The left side 820 and the right side 860 are completely folded to each other to face each other. In addition, the center side 840 and the left side 820, and the center side 840 and the right side 860 form right angles. Because the media type is the 360 degree sound output, the shape of the flexible electronic device 100 as shown in FIG. 8B may be the optimal shape. The sound output from each of the speakers 802, 804, and 806 does not interfere with each other, and the user may have a 360 degree (surround) sound experience.

Figure 8C:
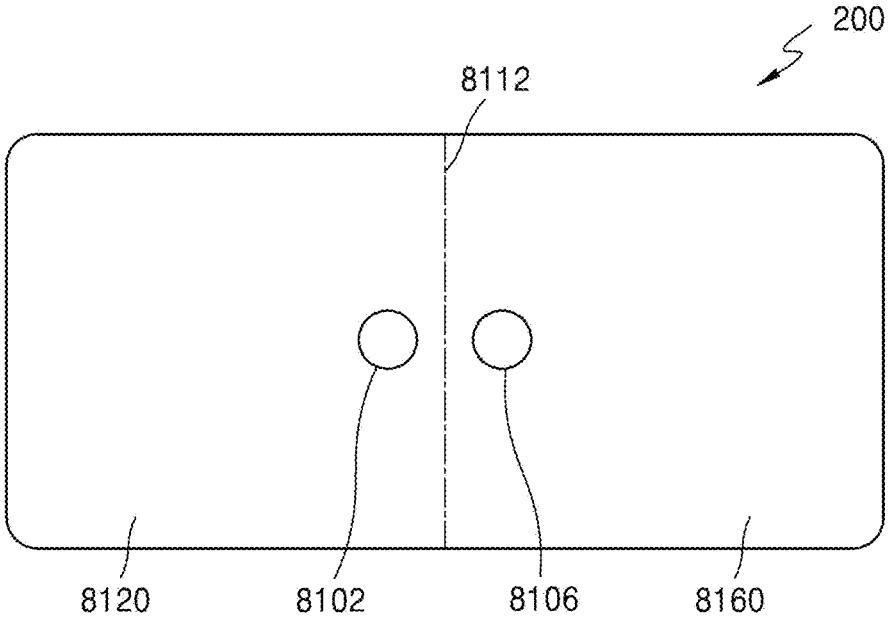
FIG. 8C is a schematic diagram of a flexible electronic device according to an embodiment.

FIG. 8C is a schematic diagram of a flexible electronic device 200 according to an embodiment.

Unlike FIG. 8A or 8B, according to FIG. 8C, the flexible electronic device 200 has only one bending line 8112. Accordingly, the flexible electronic device 200 has a left side 8120 and a right side 8160 on both sides of one bending line 8112.

As explained in Table 1 above, when the media type is a loud mono speaker output, both two speakers 8102 and 8106 are used equally to output loud and clear sound without folding of the flexible electronic device 200.

Figure 8D:
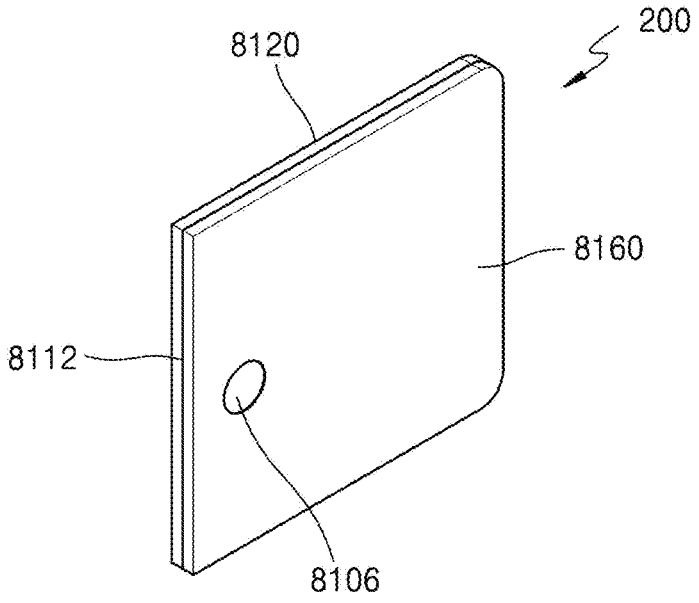
FIG. 8D is a schematic diagram of a flexible electronic device according to an embodiment.

FIG. 8D is a schematic diagram of the flexible electronic device 200 according to an embodiment.

According to FIG. 8D, the flexible electronic device 200 is completely folded based on the bending line 8112. That is, the left side 8120 and the right side 8160 of the flexible electronic device 200 completely face each other and form a 0 degree angle.

In an embodiment, FIG. 8D shows the shape of the flexible electronic device 200 when the media type according to Table 1 is identified to be a 360 degree sound output.

In an embodiment, unlike the flexible electronic device 100 of FIG. 8B with three speakers, the flexible electronic device 200 according to FIG. 8D has only two speakers, and thus the flexible electronic device 200 has no central sound output. Accordingly, unlike the case of FIG. 8B, in FIG. 8D, the flexible electronic device 200 may have a shape that conforms to the 360 degree sound output even when the left side 8120 and the right side 8160 form an angle of 0 degree to less than 30 degrees.

Figure 9A:
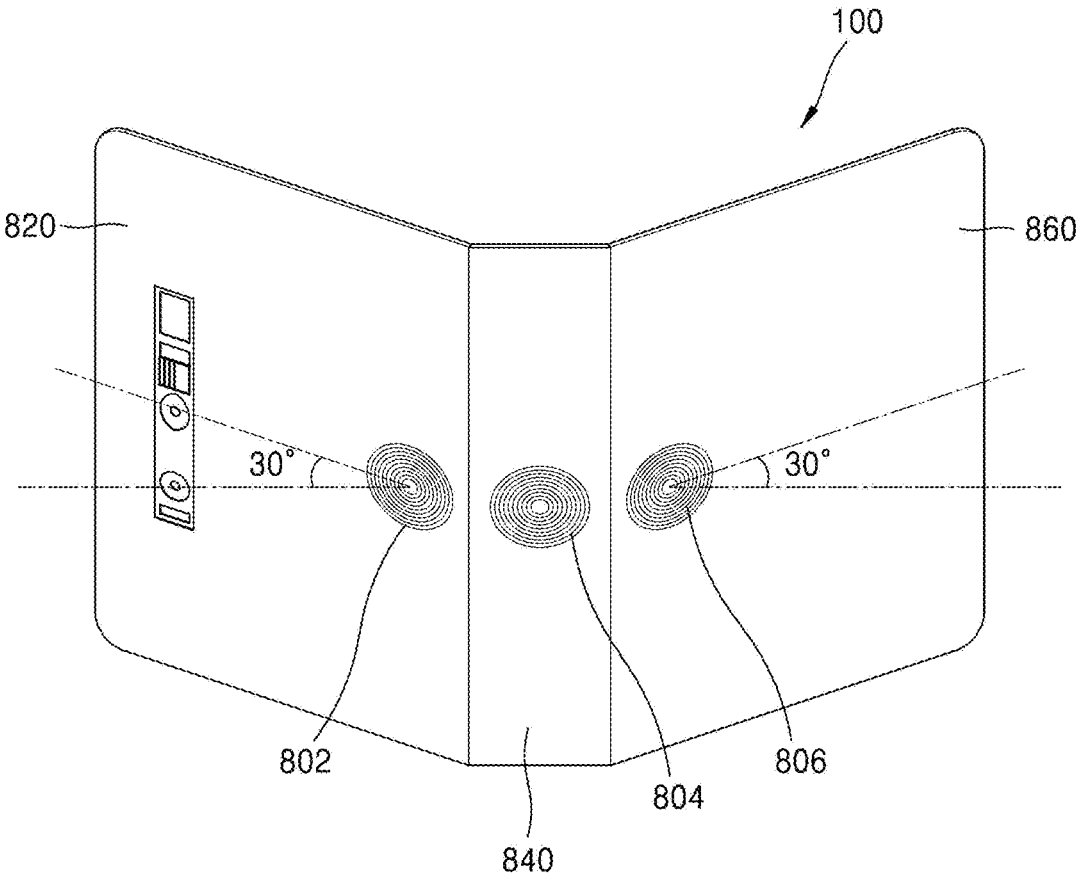
FIG. 9A is a schematic diagram of a flexible electronic device according to an embodiment.

FIG. 9A is a schematic diagram of the flexible electronic device 100 according to an embodiment.

Referring to FIG. 9A, in Table 1, the audio data type is stereo sound and the media type is surround output.

In an embodiment, an angle formed by the verticality of the center side 840 of the flexible electronic device 100 and the left side 820 is 60 degrees so as to conform to the surround output media type. That is, the left side 820 forms an angle of 30 degrees with the center side 840. Likewise, the right side 860 forms a 30 degree angle with the center side 840.

In an embodiment, bass and speech components may be output by the central speaker 804. Even when the media type of the audio data is the surround output, the flexible electronic device 100 is not limited to the angle formed by the verticality of the center side 840 of the flexible electronic device 100 and the left side 820 is 60 degrees, and the angle formed by the verticality of the center side 840 and the left side 820 may be readjusted so as to produce the optimal surround output.

In an embodiment, when the central speaker 804 is not used, the angle formed by the left side 820 and the verticality of the center side 840 in the flexible electronic device 100 may be greater than 60 degrees.

Figure 9B:
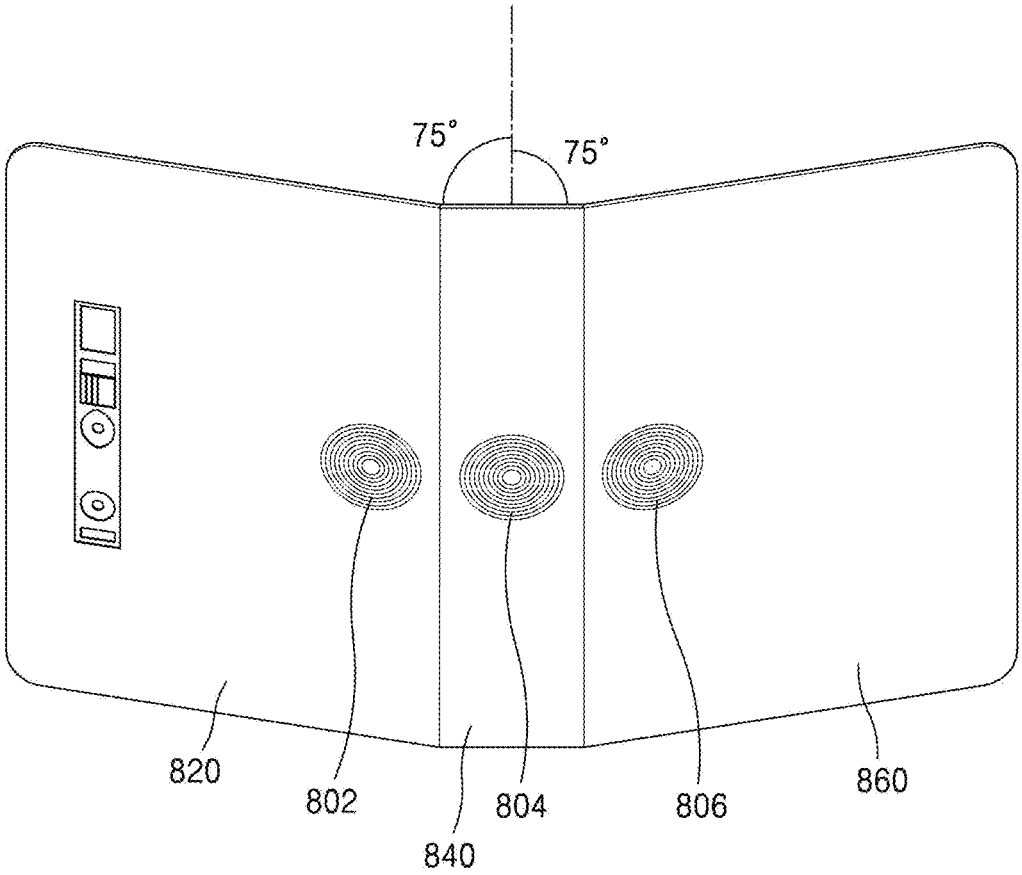
FIG. 9B is a schematic diagram of a flexible electronic device according to an embodiment.

FIG. 9B is a schematic diagram of the flexible electronic device 100 according to an embodiment.

Referring to FIG. 9B, when the media type according to Table 1 is a stereo sound output, compared to the case in FIG. 9A, an angle formed by the verticality of the center side 840 of the flexible electronic device 100 and the left side 820 may be greater than 60 degrees.

In an embodiment, when the media type according to Table 1 is the stereo sound output, only the left speaker 802 and the right speaker 806 may be used while the central speaker 804 is not used.

Figure 9C:
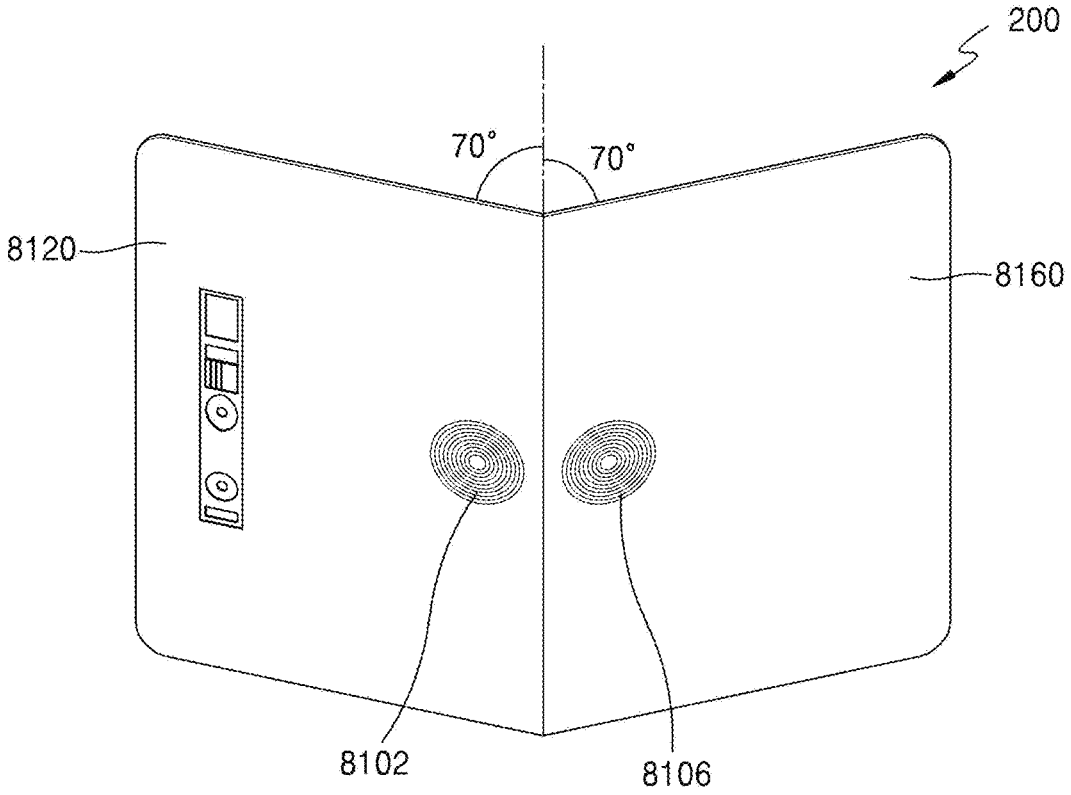
FIG. 9C is a schematic diagram of a flexible electronic device according to an embodiment.

FIG. 9C is a schematic diagram of the flexible electronic device 200 according to an embodiment.

FIG. 9C shows a case in which the media type is the stereo sound output in the flexible electronic device 200 having one bending line as shown in FIG. 8C.

In FIG. 9C, the flexible electronic device 200 does not have a central speaker and a center side. When the media type of the audio data is the stereo sound output, an angle formed by each of the left side 8120 and the right side 8160 of the flexible electronic device 200 with the vertical side of the bending line may be approximately greater than 60 degrees.

FIG. 10 is a schematic diagram of a flexible electronic device 300 according to an embodiment.

Until now, a flexible electronic device has a structure in which a bending (folding) side is folded with respect to a bending line, whereas the flexible electronic device 300 according to FIG. 10 has a structure in which a bending (folding) side is curved without a bending line.

The flexible electronic device 300 according to FIG. 10 has a left speaker 1002 and a right speaker 1006, but according to an embodiment, the flexible electronic device 300 may further include a central speaker. The flexible electronic device 300 may further include a plurality of speakers according to an embodiment.

In an embodiment, when the media type is a stereo sound output, the left speaker 1002 and the right speaker 1006 of the flexible electronic device 300 may be configured in a curved state that an angle formed by a tangent of the left speaker 1002 and a tangent of the right speaker 1006 is 140 degrees.

Figure 11A:
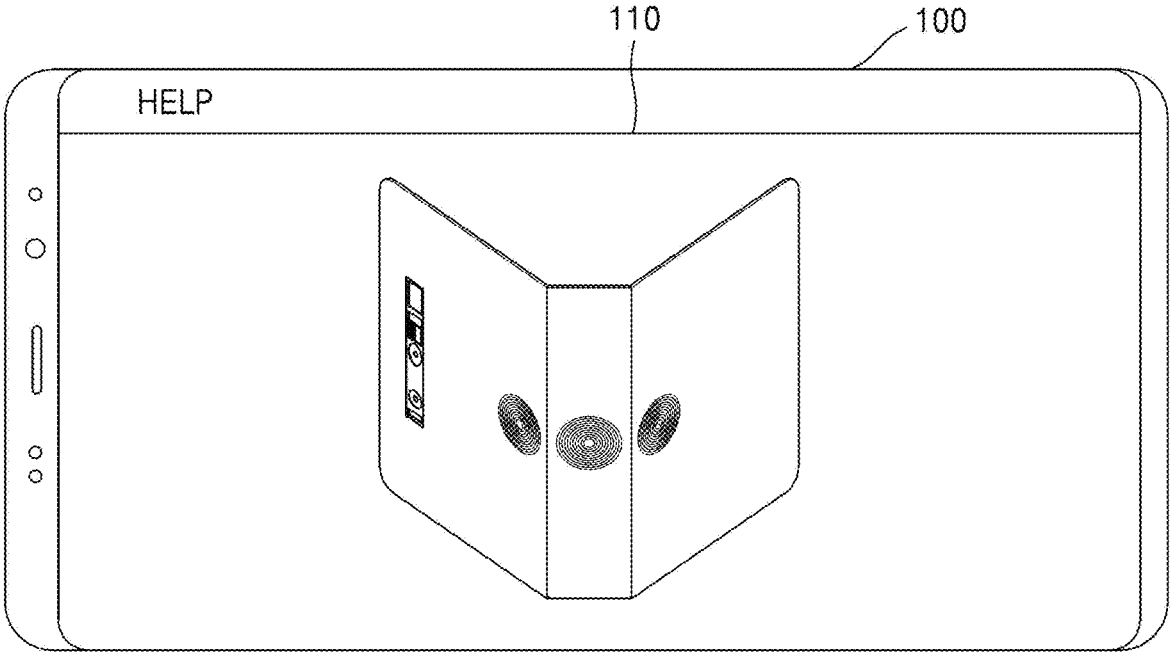
FIG. 11A is a diagram showing a shape of a flexible electronic device on a display according to an embodiment.

FIG. 11A is a diagram showing a shape of the flexible electronic device 100 on the display 170 according to an embodiment.

When the processor 120 analyzes audio data and identifies an angle that needs to be formed by the left side 820, the center side 840, and the right side 860, a shape that the flexible electronic device 100 needs to have is identified. The identified shape is displayed on the display 170 of the flexible electronic device 100 to induce a user to bend the flexible electronic device 100 to the corresponding shape. In an embodiment, the processor 120 controls the controller 150 to bend the left side 820, the center side 840, and the right side 860 so as to automatically configure the identified shape. Bending is performed by controlling a motor provided on a hinge between the left side 820 and the center side 840 and a motor provided on a hinge between the center side 840 and the right side 860. Alternatively, the left side 820, the center side 840, and the right side 860 may be automatically bent to the flexible electronic devices 100, 200, and 300 through a piezoelectric element or a magnetic element.

In case where the user manually bends the flexible electronic device 100, when the desired shape is configured, the flexible electronic device 100 may notify the user through sound, vibration, or visual effects.

Figure 11B:
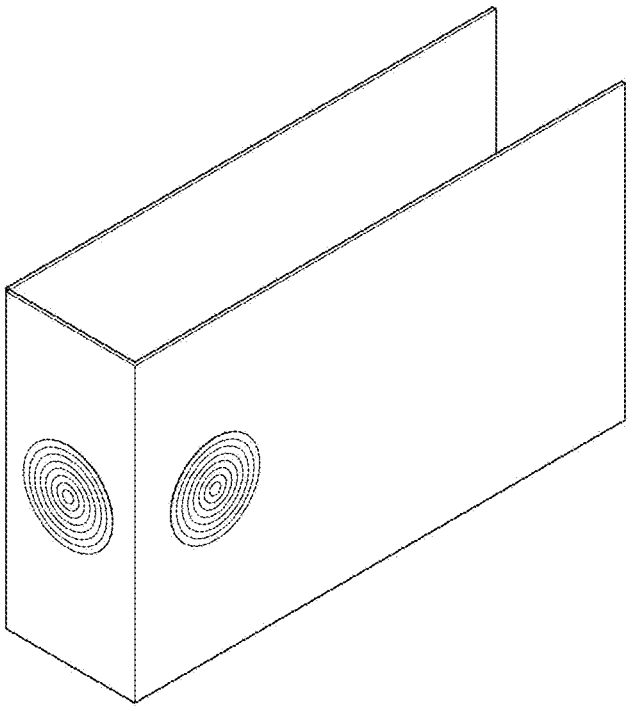
FIG. 11B is a diagram showing a shape of a flexible electronic device according to an embodiment.

FIG. 11B is a diagram showing a shape of the flexible electronic device 100 according to an embodiment.

Referring to FIG. 11B, when the media type of audio is surround output, the display 170 shows a shape that the flexible electronic device 100 needs to have.

Figure 12:
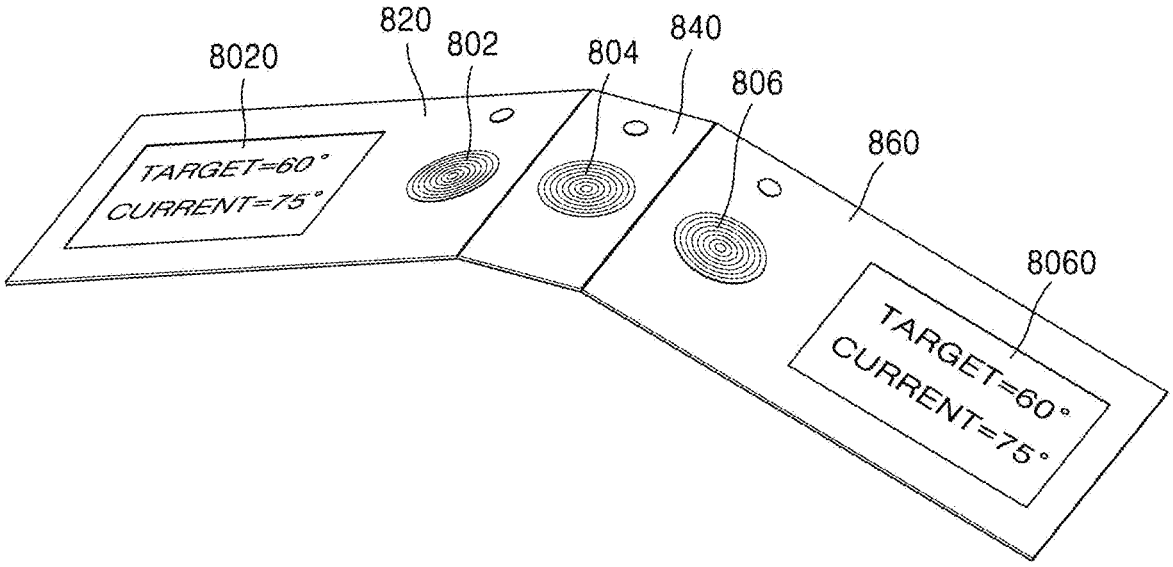
FIG. 12 is a diagram showing an angle for configuring a desired shape of a flexible electronic device according to an embodiment.

FIG. 12 is a diagram showing an angle for configuring a desired shape of the flexible electronic device 100 according to an embodiment.

In an embodiment according to FIG. 12, the flexible electronic device 100 includes a left-display 8020 and a right display 8060 on the left side 820 and the right side 860, respectively.

In an embodiment, the left-display 8020 may display a target angle that needs to be achieved by the left side 820 and the center side 840 and a current angle that changes in real time to help in folding while checking an angle value to which degree the user needs to bend the left side 820. Likewise, the right display 8060 may display a target angle that needs to be achieved by the right side 860 and the center side 840 and a current angle that changes in real time to help in folding while checking an angle value to which degree the user needs to bend the right side 860.

This is only an example, and the left target angle and the current angle, and the right target angle and the current angle may be displayed on one display. One display may be a display positioned on the folding inside.

Figure 13A:
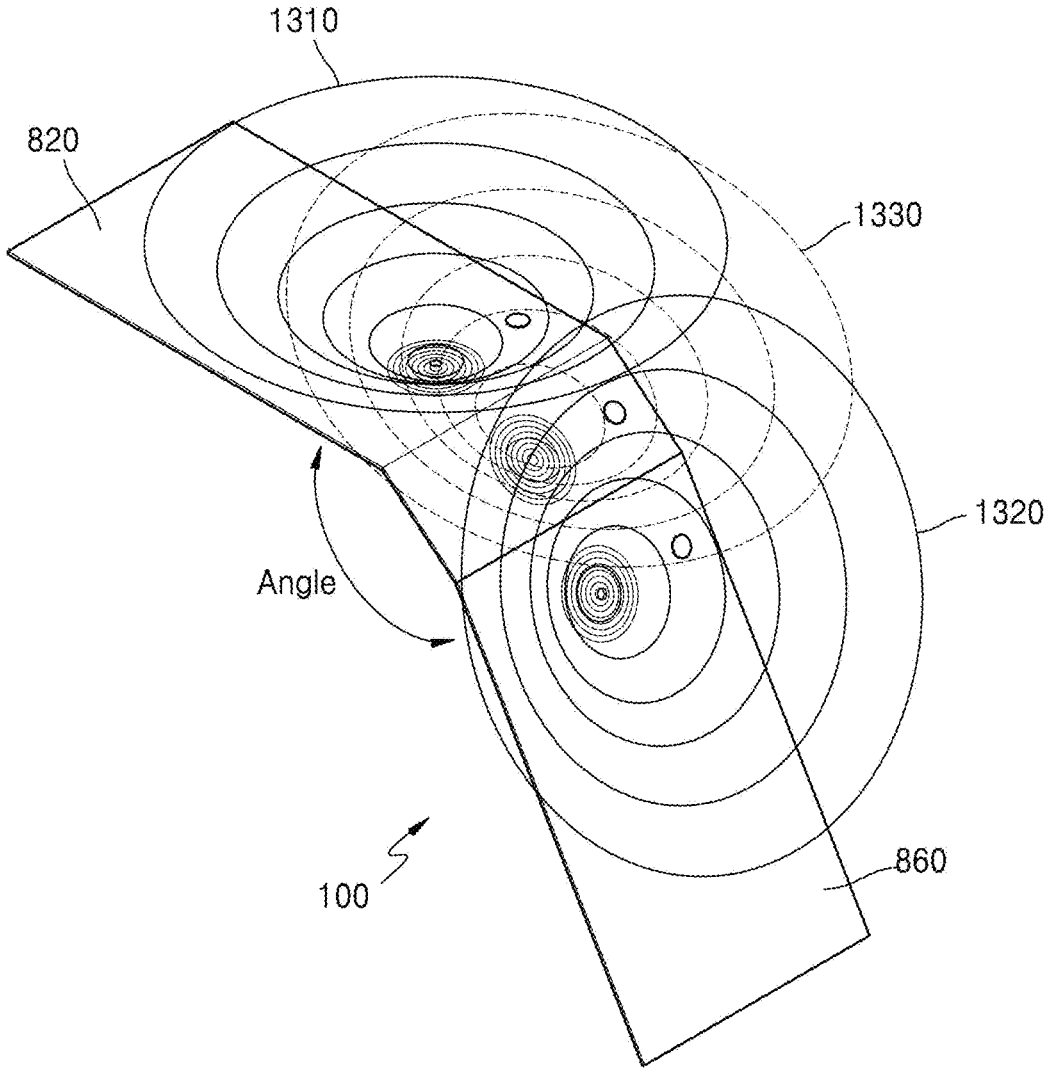
FIG. 13A is a diagram illustrating interference or overlap of audio signals in a flexible electronic device according to an embodiment.

FIG. 13A is a diagram illustrating interference or overlap of audio signals in a flexible electronic device according to an embodiment.

Referring to FIG. 13A, the flexible electronic device 100 shows an area 1330 in which the interference or overlap occurs between an audio signal 1310 output from the left side 820 and an audio signal 1320 output from the right side 860. In order to minimize such interference or overlap of audio signals, an angle between the left side 820 and the right side 860 of the flexible electronic device 100 needs to be smaller.

Figure 13B:
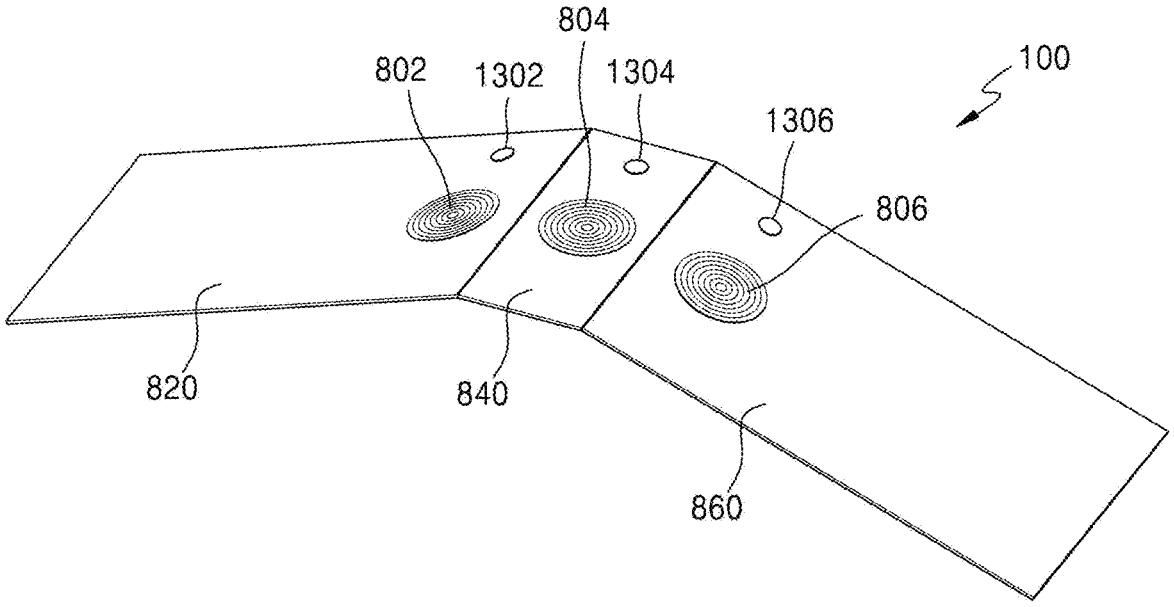
FIG. 13B shows a flexible electronic device including microphones according to an embodiment.

FIG. 13B shows the flexible electronic device 100 including left, central, and right microphones 1302, 1304, and 1306 according to an embodiment.

Referring to FIG. 13B, the left microphone 1302, the central microphone 1304, and the right microphone 1306 are respectively provided on the left side 820, the center side 840, and the right side 860 of the flexible electronic device 100.

Currently, the shape of the flexible electronic device 100 is identified by analyzing audio data. However, as a result of outputting the audio data via the speakers 802, 804, and 806 of the flexible electronic device 100, the user might not experience good listening quality due to overlap, interference, or background noise of the audio output.

In this regard, the processor 120 detects the overlap, interference, or background noise of the audio output through each of the microphones 1302, 1304, and 1306, and obtains the detected overlap, interference, or background noise of the audio output as feedback information.

The background noise may be the undesired signal which is overlapping with the current audio signal. To overcome the above-described problem, the processor 120 reflects the obtained feedback information in audio data analysis. The processor 120 may re-adjust the current angle formed by the left side 820, the center side 840, and the right side 860 by merging and analyzing the feedback information and the audio data.

In an embodiment, when the audio output (audio signal) output from the left speaker 802, the central speaker 804, and the right speaker 806 is overlapped or interfered, to avoid this, the processor 120 may reduce the angle formed by the left side 820 and the verticality of the center side 840. Likewise, the processor 120 may reduce the angle formed by the right side 860 and the verticality of the center side 840. The processor 120 may allow the controller 150 to change the shape of the flexible electronic device 100 according to the changed angle.

Figure 13C:
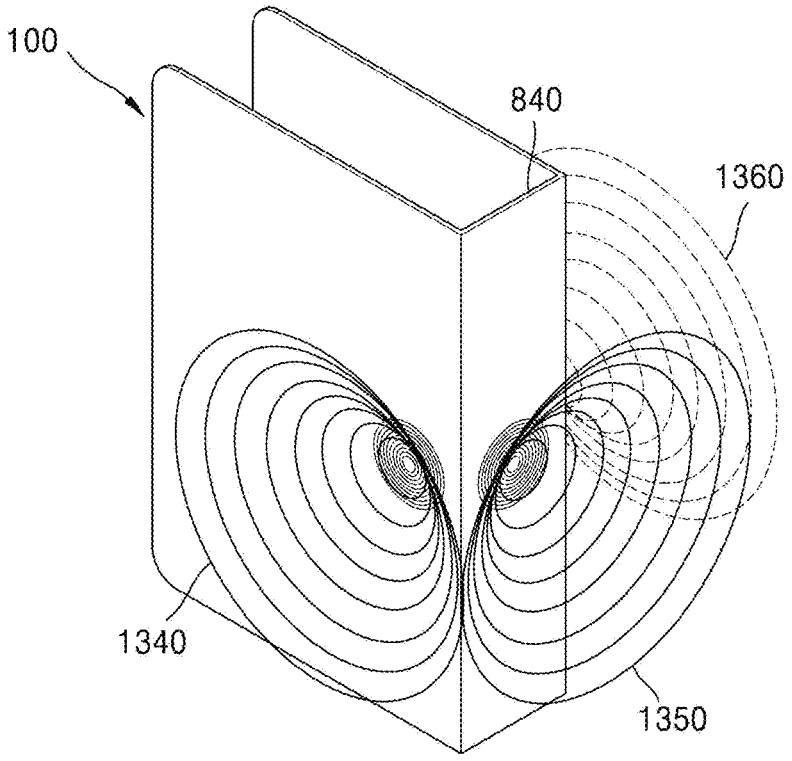
FIG. 13C is a diagram illustrating removing interference or overlap of audio signals in a flexible electronic device according to an embodiment.

FIG. 13C is a diagram illustrating removing interference or overlap of audio signals in the flexible electronic device 100 according to an embodiment.

Referring to FIG. 13C, the processor 120 changes the shape of the flexible electronic device 100 according to an angle changed by the process according to FIG. 13B. It may be seen that interference or overlap does not occur in each of audio signals 1340, 1350, and 1360 output from the flexible electronic device 100 according to the changed angle.

Figure 14:
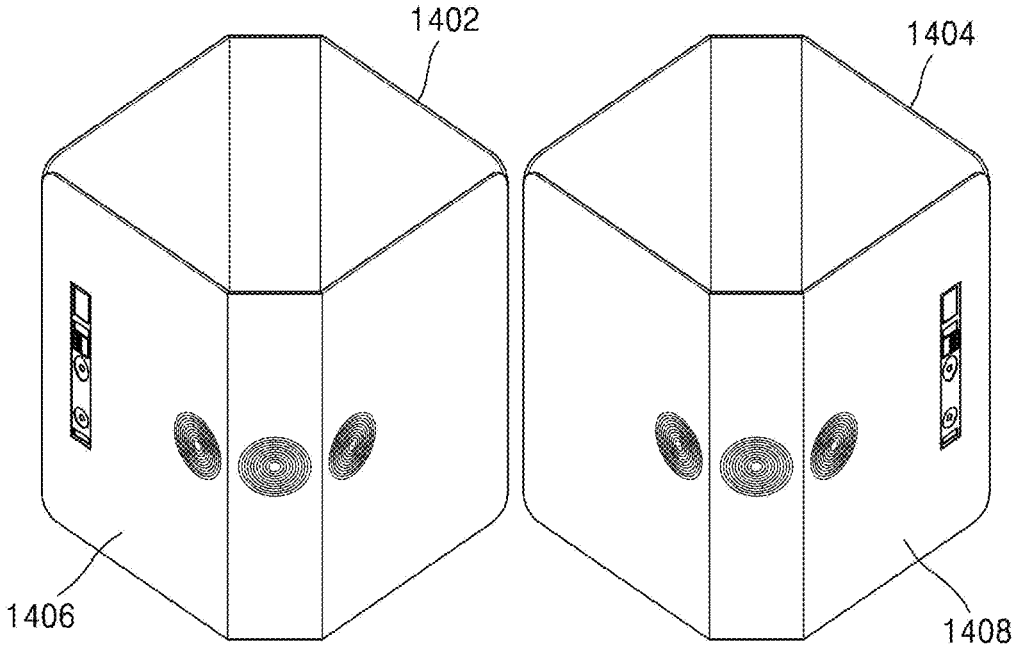
FIG. 14 is a diagram illustrating an arrangement of a plurality of flexible electronic devices according to an embodiment.

FIG. 14 is a diagram illustrating an arrangement of a plurality of flexible electronic devices 1402, 1404, 1406, and 1408 according to an embodiment.

Referring to FIG. 14, the first flexible electronic device 1402, the second flexible electronic device 1404, the third flexible electronic device 1406, and the fourth flexible electronic device 1408 have three speakers as in the flexible electronic device 100 above and forms a specific arrangement to output a loud and clear sound combination. When the plurality of flexible electronic devices 1402, 1404, 1406, and 1408 has the arrangement according to FIG. 14, the plurality of flexible electronic devices 1402, 1404, 1406, and 1408 may implement almost perfect surround sound output.

Figure 15:
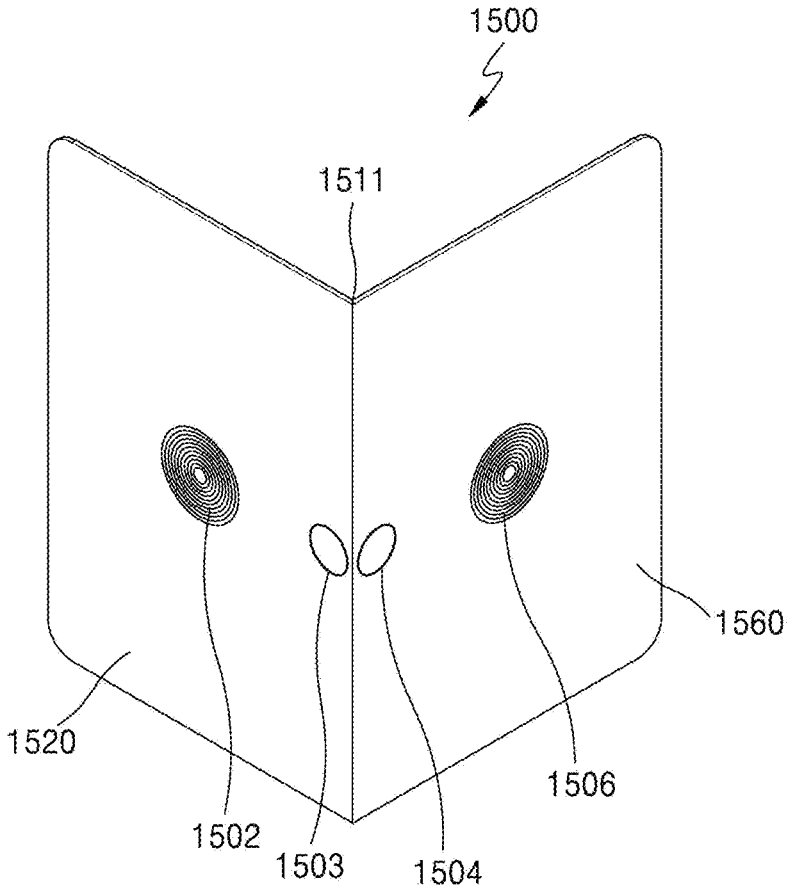
FIG. 15 is a diagram illustrating a flexible electronic device according to an embodiment.

FIG. 15 is a diagram illustrating a flexible electronic device 1500 according to an embodiment.

The flexible electronic device 1500 according to FIG. 15 has a structure in which a left side 1520 and a right side 1560 are folded with one bending line 1511.

The flexible electronic device 1500 according to FIG. 15 includes two speakers 1503 and 1504 that may serve as a central speaker near the bending line 1511 so as to produce an audio output effect similar to that of the flexible electronic device 100 including the central speaker and includes a left speaker 1502 and a right speaker 1506. The two speakers 1503 and 1504 may be rarely influenced by an angle at which the left side 1520 and the right side 1560 of the flexible electronic device 1500 are folded and may serve as the central speaker. However, when the angle between the left side 1520 and the right side 1560 is very small (for example, 15 degrees or less), the two speakers 1503 and 1504 may be difficult to serve as the central speaker, but the two speakers 1503 and 1504 may similarly serve as the central speaker of the flexible electronic device 100 except that the angle between the left side 1520 and the right side 1560 is very small.

Embodiments may be implemented through at least one software program running on at least one hardware device and performing a network management function to control elements of the hardware device.

The methods according to an embodiment may be implemented in the form of program commands that can be executed through various computer components and recorded in a computer-readable recording medium. The computer-readable recording medium may include a program command, a data file, a data structure and the like solely or in a combined manner. The program command recorded in the computer-readable recording medium may be a program command specially designed and configured for the embodiments or a program command known to be used by those of skill in the art of the computer software field. Examples of the computer-readable recording medium may include magnetic media such as a hard disk, a floppy disk, and magnetic tape, optical media such as compact disk read only memory (CD-ROM) and digital versatile disk (DVD), magneto-optical media such as a floptical disk, and a hardware device especially configured to store and execute a program command, such as read only memory (ROM), random access memory (RAM) and flash memory, etc. Further, examples of the program commands include machine language code created by a compiler and high-level language code executable by a computer using an interpreter.

A flexible mobile device including a plurality of speakers according to the disclosure may adjust an arrangement of the plurality of speakers provided on the flexible mobile device based on the flexibility of the mobile device according to the nature and type of audio content, thereby implementing the speaker sound output suitable for the audio content.

Although the embodiments of the disclosure have been described above in detail, the scope of the disclosure is not limited thereto and those of ordinary skill in the art will understand that various modifications and improvements may be made therein without departing from the spirit and scope of the disclosure as defined by the following claims.

What is claimed is:

1. An audio output method performed by a flexible electronic device, the audio output method comprising:

analyzing an audio data, wherein the analyzing of the audio data comprises identifying a contribution of a plurality of frequency bands in the audio data, respectively, by analyzing frequency components of the audio data;

identifying an angle between bending sides of the flexible electronic device including a plurality of speakers, based on a result of the analyzing the audio data;

adjusting an angle between the bending sides of the flexible electronic device to the identified angle; and outputting the audio data via the plurality of speakers included in the flexible electronic device of which the bending sides have been adjusted to the identified angle.

2. The audio output method of claim 1, wherein the analyzing the audio data further comprises identifying whether the audio data is mono channel audio data or stereo channel audio data based on analyzing a channel of the audio data.

3. The audio output method of claim 1, wherein the plurality of frequency bands comprise at least two from among a bass band, a music effects band, a speech band, and a clear band.

4. The audio output method of claim 3, further comprising:

identifying a type of the audio data based on the contribution of the plurality of frequency bands, respectively.

5. The audio output method of claim 4, wherein the identifying the angle between the bending sides of the flexible electronic device further comprises:

identifying the angle between the bending sides of the flexible electronic device according to the contribution of the plurality of frequency bands, respectively.

6. The audio output method of claim 2, wherein, based on the audio data being identified as the stereo channel audio data, an angle between a left side and a right side among the bending sides of the flexible electronic device is determined to be between 50 degrees and 180 degrees.

7. The audio output method of claim 1, wherein at least one speaker among the plurality of speakers is provided on each of the bending sides of the flexible electronic device, respectively.

8. The audio output method of claim 1, wherein the adjusting the angle between the bending sides of the flexible electronic device further comprises:

bending the flexible electronic device by folding at least two sides included in the flexible electronic device or curving at least one side of the flexible electronic device.

9. The audio output method of claim 1, further comprising:

providing a notification to a user when the identified angle is configured between the bending sides of the flexible electronic device.

10. The audio output method of claim 1, wherein the adjusting the angle between the bending sides of the flexible electronic device further comprises:

providing an image in which the identified angle is configured between the bending sides of the flexible electronic device.

11. The audio output method of claim 1, wherein the adjusting the angle between the bending sides of the flexible electronic device further comprises:

automatically bending the bending sides of the flexible electronic device to configure the identified angle.

12. The audio output method of claim 11, further comprising:

based on an audio output according to the audio data ending and an audio according to second audio data starting to being output, reidentifying the angle between the bending sides of the flexible electronic device according to the second audio data and automatically bending the bending sides of the flexible electronic device to the reidentified angle.

13. The audio output method of claim 1, further comprising:

detecting an audio output via a microphone provided in the flexible electronic device as second audio data; and readjusting the angle between the bending sides of the flexible electronic device by analyzing the detected second audio data.

14. A flexible electronic device comprising:

a plurality of speakers; and a processor configured to:

analyze an audio data, identify an angle between bending sides of the flexible electronic device comprising the plurality of speakers, based on a result of the analyzing the audio data, adjust an angle between the bending sides of the flexible electronic device to the identified angle, and output the audio data via the plurality of speakers included in the flexible electronic device of which the bending sides have been adjusted to the identified angle, wherein the processor is further configured to identify a contribution of a plurality of frequency bands in the audio data, respectively, by analyzing frequency components of the audio data.

15. The flexible electronic device of claim 14, wherein the processor is further configured to identify a type of the audio data based on the contribution of the plurality of frequency bands, respectively.

16. The flexible electronic device of claim 15, wherein the processor is further configured to identify the angle between the bending sides of the flexible electronic device based on the contribution of the plurality of frequency bands, respectively.

17. The flexible electronic device of claim 14, wherein, based on the audio data being identified as stereo channel audio data based on the result of the analyzing the audio data, an angle between a left side and a right side among the bending sides of the flexible electronic device is identified to be between 50 degrees and 180 degrees.

18. The flexible electronic device of claim 14, further comprising at least two bending lines and at least three bending sides along the at least two bending lines, wherein at least one speaker among the plurality of speakers is provided on at least two of the at least three bending sides, and wherein the bending sides are included in the at least three bending sides.

* * * * *